US005402215A

United States Patent [19]

Yamaji

[11] Patent Number: 5,402,215

[45] Date of Patent: Mar. 28, 1995

[54] IMAGE FORMING APPARATUS

[75] Inventor: Masaaki Yamaji, Tokyo, Japan

[73] Assignee: Canon Kabushiki Kaisha, Tokyo, Japan

[21] Appl. No.: 247,404

[22] Filed: May 23, 1994

Related U.S. Application Data

[63] Continuation of Ser. No. 932,222, Aug. 19, 1992, abandoned.

[30] Foreign Application Priority Data

Aug. 20, 1991 [JP] Japan ..... 3-208029

[51] Int. Cl.[6] ..... G03G 15/09

[52] U.S. Cl. ..... 355/251; 355/253; 118/657; 118/658

[58] Field of Search ..... 355/245, 251, 253; 118/653, 656, 657, 658, 661

[56] References Cited

U.S. PATENT DOCUMENTS

| | | | |
|---|---|---|---|
| 4,504,136 | 3/1985 | Yoshikawa et al. | 118/658 X |
| 4,800,412 | 1/1989 | Ueda | 118/658 X |
| 4,841,332 | 6/1989 | Haneda et al. | 355/251 |
| 4,844,008 | 7/1989 | Sakemi et al. | 118/658 |
| 4,916,492 | 4/1990 | Hoshika et al. | 355/253 |
| 4,933,254 | 6/1990 | Hosoi et al. | 430/122 |
| 4,941,019 | 7/1990 | Honda et al. | 355/251 |
| 5,001,517 | 3/1991 | Hosaka et al. | 355/251 X |
| 5,036,364 | 7/1991 | Murasawa | 355/251 |
| 5,051,782 | 9/1991 | Yamaji | 355/251 |
| 5,060,023 | 10/1991 | Higashiguchi et al. | 355/251 |
| 5,070,812 | 10/1991 | Yamaji | 118/253 |
| 5,129,357 | 7/1992 | Yamaji | 118/658 |
| 5,296,328 | 3/1994 | Fuji et al. | 355/251 X |

FOREIGN PATENT DOCUMENTS

400555A2 5/1990 European Pat. Off. .

*Primary Examiner*—Matthew S. Smith

*Attorney, Agent, or Firm*—Fitzpatrick, Cella, Harper & Scinto

[57] ABSTRACT

An image forming apparatus includes a movable image bearing drum; a device for forming a dot distribution electrostatic latent image on the drum in accordance with an image signal; a developing device for developing the dot distribution electrostatic latent image with a developer containing magnetic carrier particles and toner particles, the developing device including a rotatable developer carrying sleeve for carrying the developer to a developing zone, voltage source for applying an oscillating bias voltage to the sleeve, and a magnet stationarily disposed in the sleeve; wherein the magnet has first and second magnetic poles opposite polarities first magnetic pole being positioned upstream of a position where the drum and the sleeve are closest to each other and in an upstream part of the developing zone, the second magnetic pole is positioned downstream of the developing zone, wherein a downstream part of the developing zone include a region where an angle of magnetic line of force relative to a surface of the developer carrying member is not more than 15 degrees, and wherein the magnet is effective to contact chains of developer to the drum in the upstream part of the developing zone.

13 Claims, 9 Drawing Sheets

IMAGE FORMING APPARATUS

This application is a continuation of application Ser. No. 07/932,222, filed Aug. 19, 1992, now abandoned.

FIELD OF THE INVENTION AND RELATED ART

The present invention relates to an image forming apparatus in which a dot distribution electrostatic latent image is formed on an image bearing member and is developed with a developer containing toner and magnetic carrier particles.

In a known developing method, as disclosed in U.S. Pat. No. 4,933,254 a two-component developer containing toner and magnetic carrier particles is conveyed on a developer carrying member into a developing zone where the developer is formed into a magnetic brush of the developer, and is contacted to the image bearing member while an oscillating bias voltage is applied onto the developer carrying member so as to develop the electrostatic latent image with the toner particles deposited both on the brush and on the developer carrying member surface. This method is advantageous in achieving high developing efficiency and a high density developed image, because the toner particles deposited on the developer carrying member surface as well as the developer on the brush, can be used for the development.

On the other hand, in a known image forming apparatus, as disclosed in EP-A-0,400,555, an electrostatic latent image is formed by exposing an image bearing member to a laser beam which is on-off-modulated in accordance with the record image to be printed, and the latent image is developed through the above-described developing method. In this specification, the electrostatic latent image or the like which is formed by exposing a photosensitive member to light spot on-off-controlled in accordance with the record image signal, or dot-like electrostatic latent image spots which are imagewisely distributed in a desired area, will be called a dot distribution electrostatic latent image. Thus, the dot distribution electrostatic latent image is a set of the pixel latent images. This is also known as a digital electrostatic latent image, as distinguished from an analog electrostatic latent image, which is provided by projecting an optical image of an original directly onto an electrophotographic photosensitive member. In addition, a visualized image provided by dot-like visualized pixel images as a result of development of the dot distribution electrostatic latent image, will be called a dot distribution visualized image, in this specification.

In such an image forming apparatus, sufficiently high density images can be provided in the high density image region for the reason described hereinbefore. However, the image reproducibility in the low image density area, comprised of the fine dot latent images, is not very good. In the intermediate tone level region provided by slightly larger dot latent images, the images are roughened. The reason for this is considered as follows. The developer brush is erected on the developer carrying member over the entire developing zone with the chains of the developer being sparsely distributed. Therefore the dot latent image located between the chains is supplied with a sufficient amount of toner from the chains and from the surface of the developer carrying member. However, the dot latent image contacted by or rubbed by the chains is not sufficiently supplied with the toner. Since the size of the dot image in the low level or intermediate level tone areas is large, the shortage of the developer is significant. Therefore, the reproducibility is not very good, or the images are roughened in the low density area or in the middle tone level area.

SUMMARY OF THE INVENTION

Accordingly, it is a principal object of the present invention to provide an image forming apparatus in which the dot distribution electrostatic latent image formed in accordance with the record image signal, can be developed into a satisfactory dot distribution visualized image.

It is another object of the present invention to provide an image forming apparatus in which the dot distribution electrostatic latent image formed in accordance with the record image signal is developed, and the developed image has sufficient density in the high density area, and the fine image without roughness can be formed in the low density region (high light region) or intermediate tone level region (half tone region) which are constituted by fine dot latent images.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
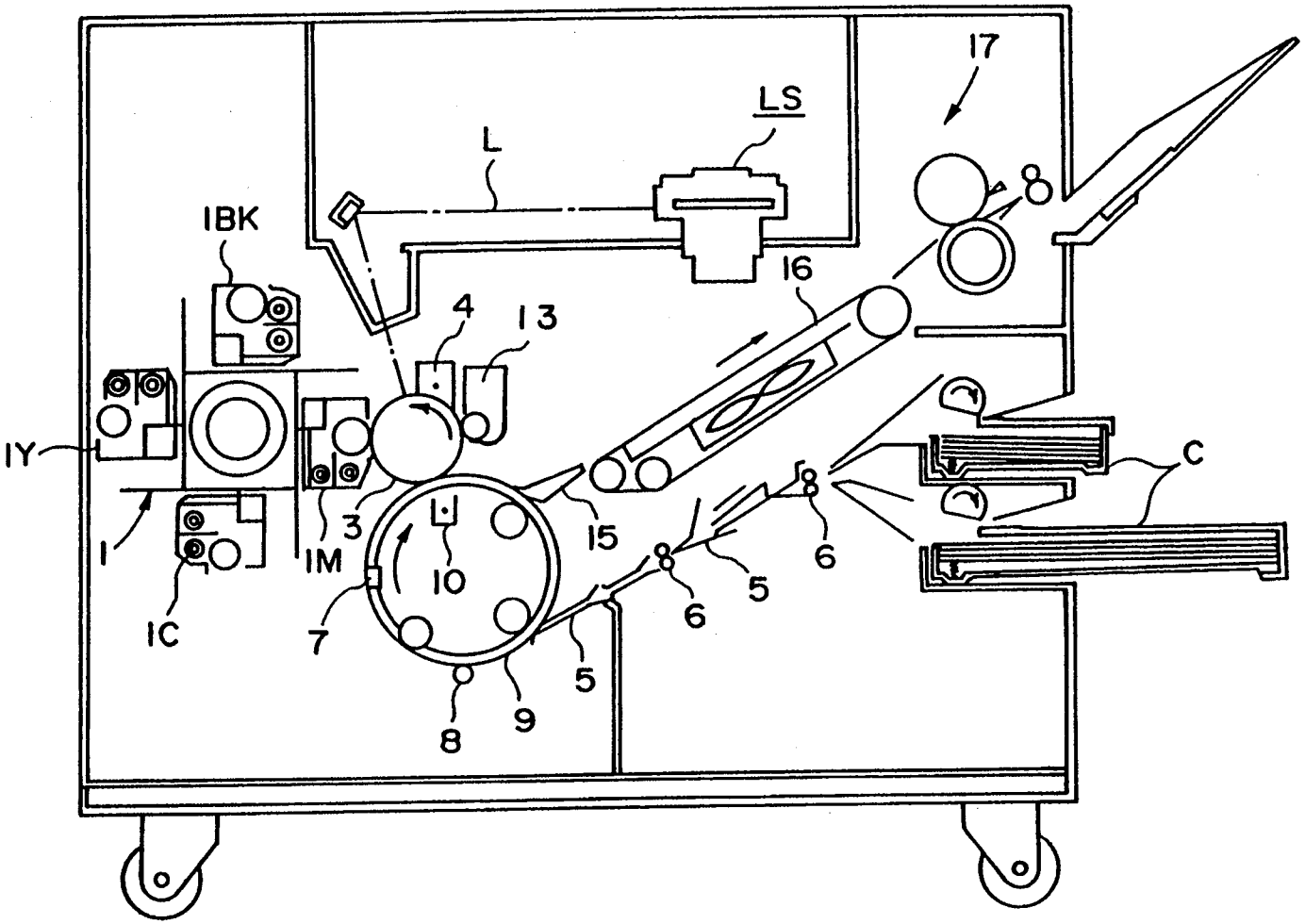
FIG. 2 is a sectional view of an image forming apparatus to which the apparatus of this invention is applicable.

Referring first to FIG. 2, there is shown an electrophotographic type color printer to which the present invention is applicable. The printer comprises an electrophotographic photosensitive drum 3, around which there are provided a charger 4, a rotary type developing device 1 having developing means 1M, 1C, 1Y and 1BK, a transfer discharger 10, a cleaning means 12 and a laser beam scanner LS. These elements constitute image forming means. Each of the developing means functions to develop the dot distributed or distribution electrostatic latent image formed on the drum 3 with two component developer containing toner particles and carrier particles. The developer in the developing means 1M contains magenta toner; the developer in the developing means 1C contains cyan toner; the developer in the developing means 1Y contains yellow toner; and the developer in the developing means 1BK contains black toner.

The original to be copied or recorded is read by an original reader. The reader comprises a photoelectric transducer element for converting an original image into electric signals, such as CCD or the like. The image signals are produced, corresponding to magenta image information, cyan image information, yellow image information and black image information of the original. The semiconductor laser is controlled in accordance with the image signals, and produces a controlled laser beam M. The image forming apparatus is capable of printing output signals from an electronic computer.

The photosensitive drum 3 is rotated in the direction indicated by an arrow, and the surface thereof is uniformly charged by the charger 4. The photosensitive drum 3 is scanned by and exposed to the laser beam L which is on-off-controlled by magenta image signals, so that a dot distribution electrostatic latent image constituted by latent image dots (pixel latent images) is formed on the photosensitive drum 3. The latent image is reverse-developed by the magenta developing device 1M which has been set at an operative position.

On the other hand, a transfer material in the form of paper is supplied from a cassette C along a sheet guide 5, by feeding rollers 6. It is gripped by a gripper 7 of a transfer drum 9, and is wrapped on the outer peripheral surface of the transfer drum 9 by means of a roller 8. The transfer drum 9 rotates in the direction indicated by an arrow in synchronism with the photosensitive drum 3. The magenta visualized image formed by the magenta developing device 1M is transferred onto the transfer material by a transfer charger 10.

After the image transfer, the surface of the photosensitive drum 3 is cleaned by cleaning means 13 so that the residual toner after the image transfer is removed. It is charged again by the charger 4, and is exposed to the laser beam L modulated in accordance with the cyan image signals in the similar manner, so that a dot distribution electrostatic latent image is formed by this time, the developing device 1 rotates by $\frac{1}{4}$ turn, so that the cyan developing device 1C is placed at the operative position to reverse-develop the cyan latent image, so that a cyan visualized image is formed. The cyan visualized image is transferred onto the transfer material.

This process is repeated for the yellow image signals and black image signals. When the transfers of four visualized (toner powder) images have been completed, the transfer material is separated from the transfer drum 9 by separation pawls 15, and is conveyed to a roller fixing device 17 on a conveying belt 16. The fixing device 14 fixes the four color visualized images overlaid on the transfer material. In this manner, the full-color print image is produced.

Figure 3:
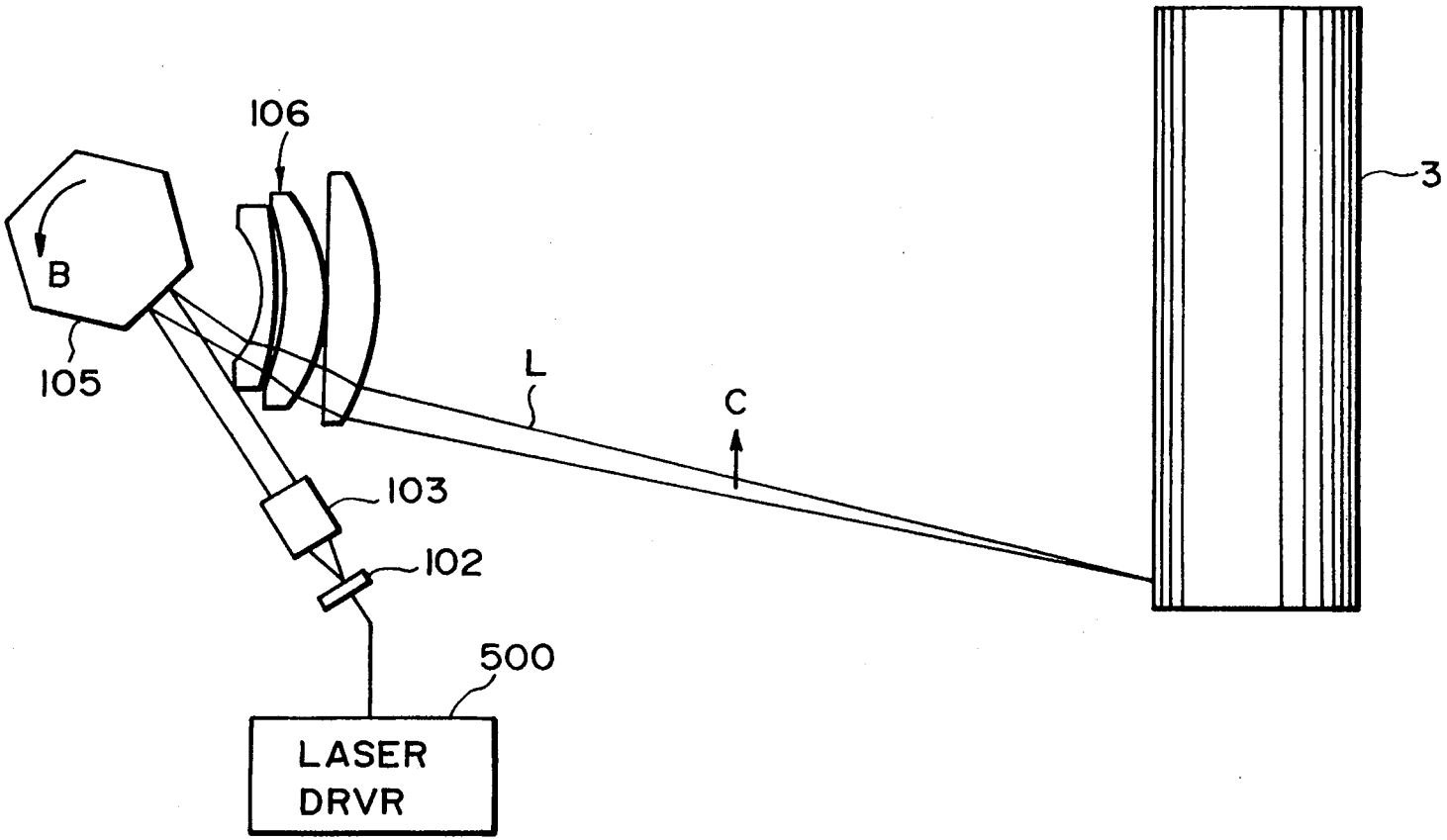
FIG. 3 shows an optical exposure system in the apparatus of FIG. 2.

As shown in FIG. 3, the exposure means comprises a semiconductor laser 102, a collimator lens 103, a polygonal mirror 105 rotating at a high speed, and an f-$\theta$ lens 106. The semiconductor laser 102 produces a laser beam L modulated in accordance with time series digital image signals supplied from an image reader or an electronic computer or the like, and is projected on the surface of the photosensitive drum 3.

Each of the developing devices effects the reverse developing operation in which the toner particles electrically charged to the same polarity as the charge polarity of the charger 4 is deposited onto the light potential portion of the latent image, and therefore, the laser beam L is projected onto the portions which are to receive the toner image. In other words, the toner is deposited on the light potential portion rather than the dark potential portion to visualize the image.

More particularly, referring to FIG. 3, the semiconductor laser element 102 is connected to a laser emitting signal (driving signal) generator in the form of a laser driver 500, and the laser is emitted in accordance with the emitting signal of the laser driver. The laser beam L emitted from a laser element 102 is collimated by a collimator lens system 103.

A rotatable polygonal mirror 105 is rotated at a constant speed in a direction indicated by an arrow B, and deflects the collimated beam through the collimator lens system 103 in the direction indicated by an arrow C. The f-$\theta$ lens 106 disposed in front of the polygonal mirror 105 is effective to form a spot image from the laser beam deflected by the polygonal mirror 105 on the photosensitive drum 3, while providing a constant scanning speed on the photosensitive drum surface.

In this specification, the direction in which the laser beam L moves on the photosensitive drum 3 by the function of the polygonal mirror 105, that is, the direction C, is called the "main scanning direction". Therefore, the main scanning direction is crossed with the movement direction of the surface of the photosensitive drum 3 at the exposure station, preferably in a perpendicular direction. The movement direction of the photosensitive drum 3 in the exposure station is called the "sub-scanning direction". The surface of the photosensitive drum 3 is raster-scanned by the main scan and the sub-scan. By the scan operation, pixel latent images (dot-like light potential portions) are formed on the photosensitive drum 3.

Figure 4:
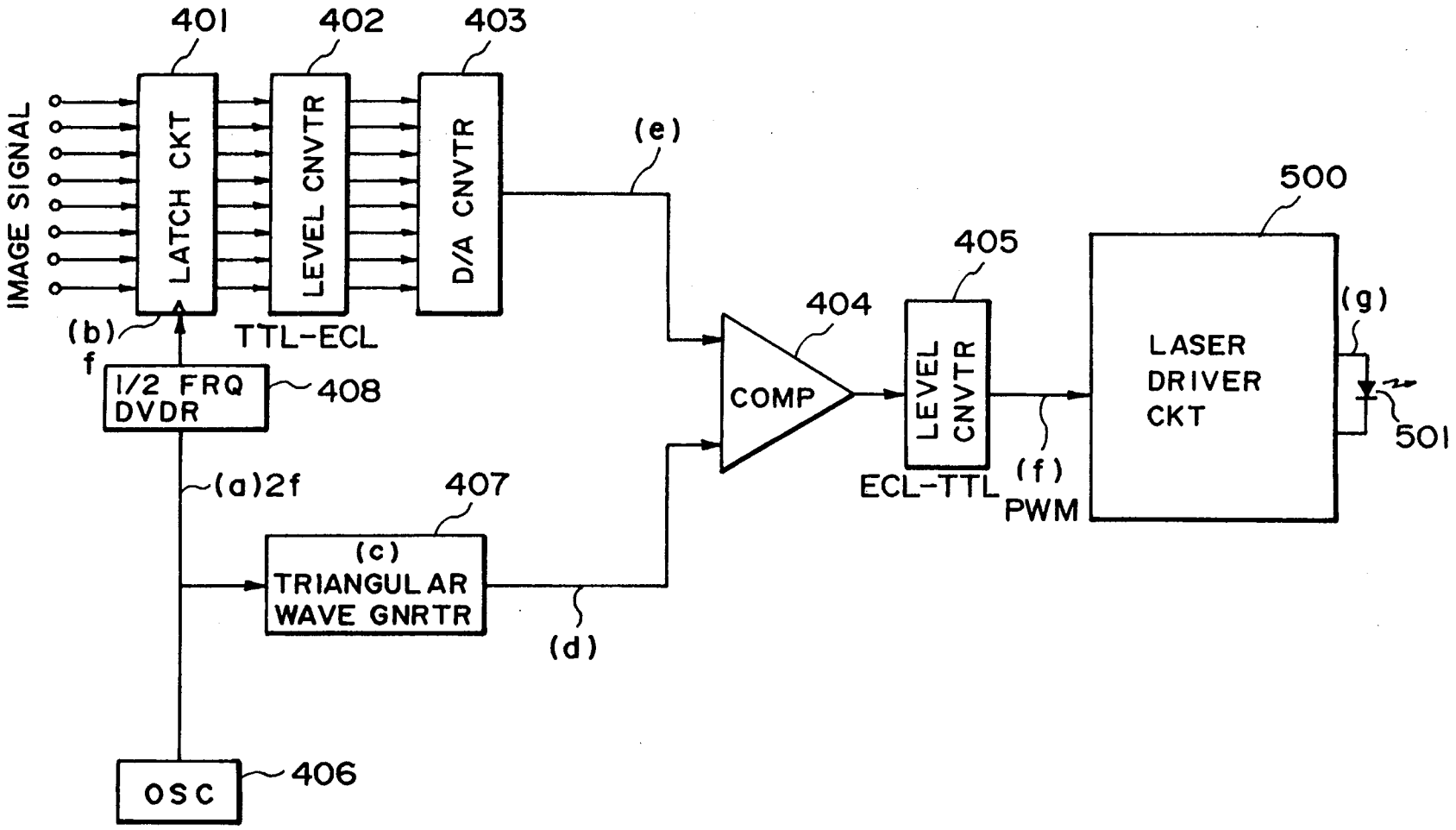
FIG. 4 is a block diagram of a PWM (pulse width modulation) control system.

Referring to FIG. 4, a PWM (pulse width modulation) circuit will be described. The PWM circuit comprises a TTL latching circuit 401 for latching 8 bit image signals, a level converter 402 for converting a TTL logic level to a high speed ECL logic level, an ECL digital-analog converter 403, an ECL comparator 404 for generating a PWM signal, a level converter 405 for converting the ECL logic level to the TTL logic level, a clock generator 406 for generating clock signals **2*f* having a frequency twice that of pixel clock signals f, a triangular wave generator 407 for generating substantially regular triangular wave signals in synchronism with the clock signals 2*f*, and $\frac{1}{2}$ frequency divider 408 for dividing the frequency of the clock signals 2*f***. For the purpose of high speed operation of the circuit, ECL logic circuits are disposed at proper positions.

Figure 5:
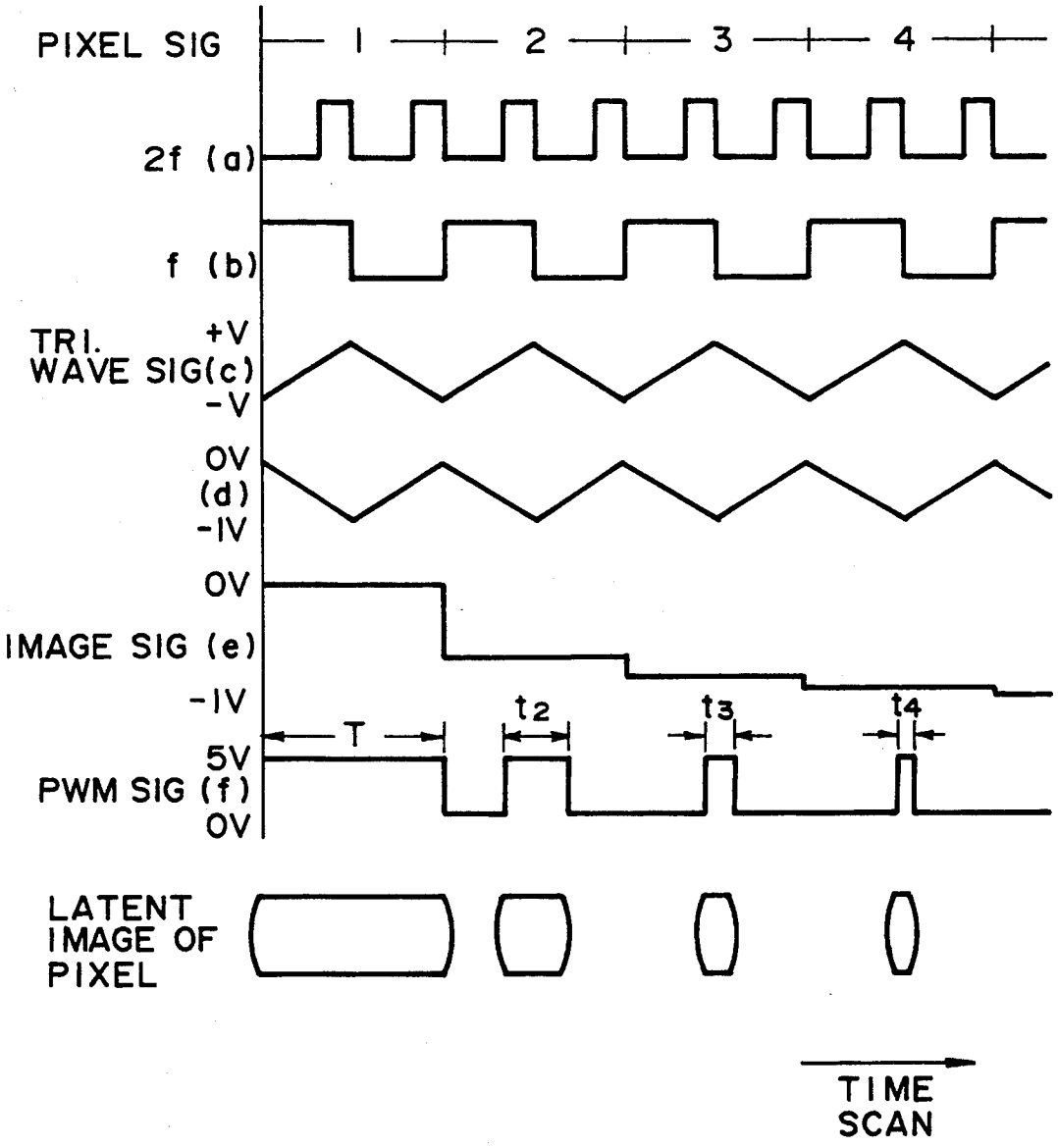
FIG. 5 is a time chart illustrating the PWM waveforms.

Referring to FIG. 5, the operation will be described. A signal (a) is the clock signal **2*f* and a signal (b) is the pixel clock signal f having double frequency, and is related with a pixel number, as indicated in the Figure. In the triangular wave generator 407, in order to maintain a 50% duty ratio of the triangular wave signal, the triangular wave signal (c) is generated after the clock signals 2*f*** are treated by $\frac{1}{2}$ frequency division. The triangular wave signal (c) is converted to the ECL level (0 to 1 V) into a triangular signal (d).

On the other hand, the pixel signal can take 256 tone levels (00H (white)—FFH (black)), where "H" means hexadecimal rotation. The pixel signal (e) is expressed as ECL voltage level provided by D/A conversion of the tone level signal. In FIG. 5, a first pixel has a maximum image density level FFH (black pixel), a second pixel has an intermediate tone level (80H), a third pixel has another intermediate tone level (40H) that is lower than that of the second pixel, a fourth pixel has a further intermediate tone level (20H) that is further lower than that of the third pixel level. The comparator 404 compares the triangular wave signal (d) and the image signal (e), and generates a PWM signal having a pulse width corresponding to the pixel density to be formed (in FIG. 5 example, the pulse Widths are T, $t_2$, $t_3$ and $t_4$), where $T>t_2>t_3>t_4$. The PWM signal is converted to the TTL level signals which are either 0 V or 5 V into a PWM signal (f) which is a laser driving pulse signal having a width which may be one of 0–256 levels. It is then fed to a laser driver circuit 500.

In this manner, the semiconductor laser 102 emits the laser beam during the time which corresponds to the respective pulse widths of the signals (f) for the respective unit pixels. The photosensitive member 3 is scanned by and is exposed to such a laser beam. Because the printer effects a reverse development process the laser emitting duration increases with the image density of the pixel. Therefore, as shown at the bottom of FIG. 5, the dot latent images (light potential portions) are provided in which higher density portion has a longer latent image in the main scan direction.

Figure 1:
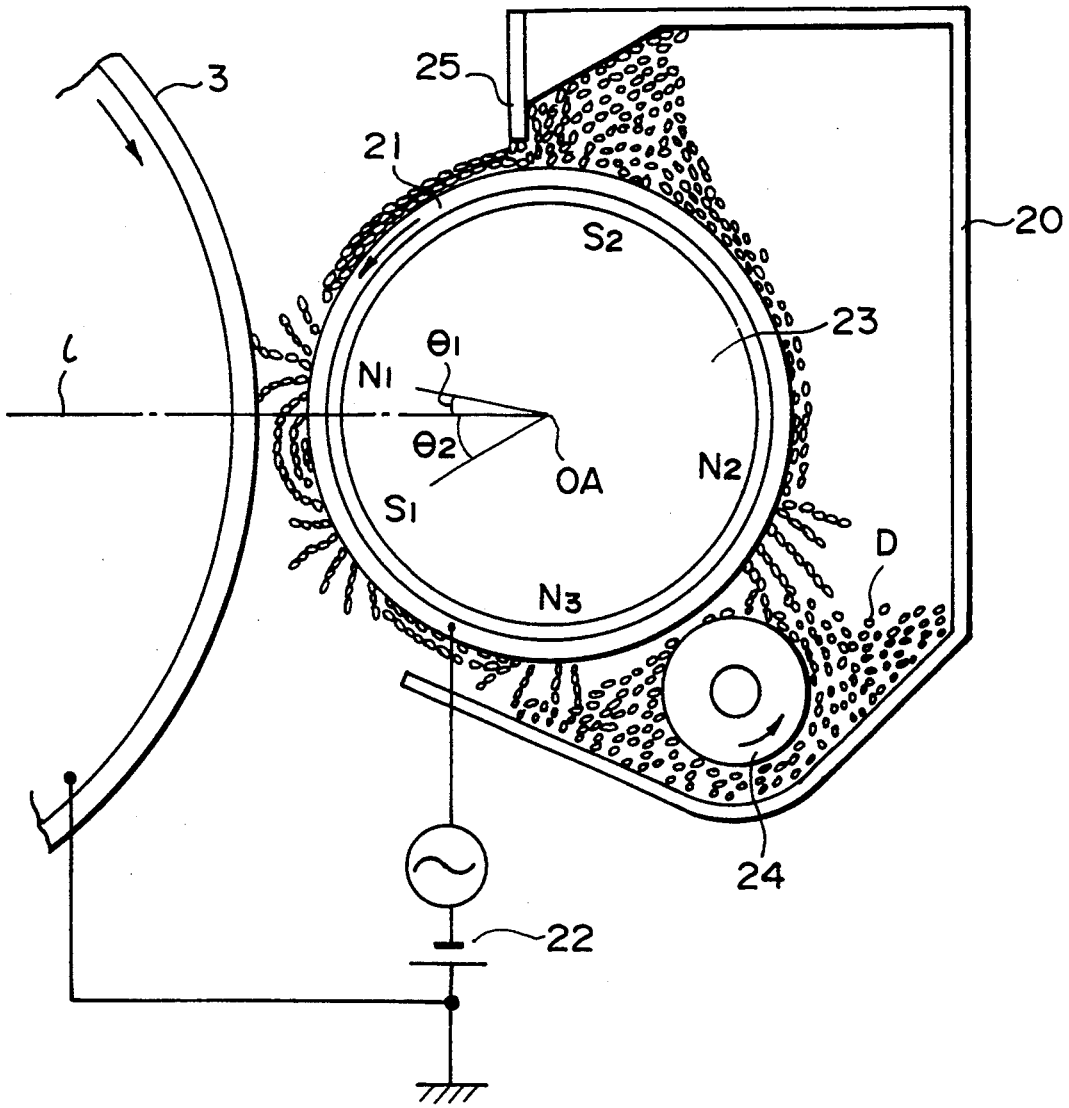
FIG. 1 is a sectional view of a developing apparatus according to an embodiment of the present invention.

In the embodiment of the present invention, the small dot latent image as indicated by pixel number 4 in FIG. 5, which constitutes a low density image portion, can be developed with predetermined density without being omitted. Referring now to FIG. 1, description will be made as to a developing apparatus used with an embodiment of the present invention. The four developing devices 1M, 1C, 1Y and 1BK of FIG. 2 each have the same fundamental structure, while the colors of the non-magnetic toner particles therein are different.

In FIG. 1, designated by a reference numeral 20 is a container for containing a two-component developer D comprising non-magnetic toner particles and magnetic carrier particles. The toner particles are electrically charged to the same polarity as the latent image by the friction with carrier particles. Non-magnetic sleeve 21 made of aluminum, stainless steel or the like, is rotated in the counterclockwise direction indicated by an arrow to carry thereon the developer D supplied thereto in the container 20. The toner particles in the developer in the developing zone, are deposited onto the dot distribution electrostatic latent image formed on the photosensitive drum 3 rotating in the clockwise direction (as shown by the arrow). The sleeve 21 and the drum 3 are rotated in the same peripheral direction in the developing zone.

The sleeve 21 is supplied with an oscillating voltage in the form of a DC biased AC voltage from a voltage source 22. The bias voltage applied to the sleeve 21 has a maximum level $V_{max}$ and a minimum voltage $V_{min}$. The latent image is constituted by a potential $V_L$ at the light portion, that is, the portion exposed to the laser beam, and a dark potential $V_D$ of a portion not exposed to the laser beam.

When the latent image is of negative polarity, that is, when $0>V_L>V_D$, the preferable bias voltage relation is $V_{max}>V_L>V_D>V_{min}$. In this case, in the phase in which the bias voltage is $V_{min}$, the toner receives a force in the direction from the sleeve to the drum, and in the phase of $V_{max}$, the toner receives the force in a direction from the drum to the sleeve. Therefore, the toner particles are reciprocated in the developing zone. In order to reverse-develop the latent image, the toner image is triboelectrically charged to a negative polarity.

When the latent image is of the positive polarity, that is, when $0<V_L<V_D$, the preferable relation is $V_{min}<V_L<V_D<V_{max}$. In this case, when the bias voltage is in the $V_{max}$ phase, the toner receives a force in the direction from the sleeve to, the drum, and in the phase of the $V_{min}$, the toner receives a force in the direction from the drum to the sleeve. Therefore, the toner is reciprocated in the developing zone. In order to reverse-develop the latent image, the toner is triboelectrically charged to a positive polarity.

Irrespective of the polarity of the latent image, the DC voltage component $V_{DC}$ is preferably between $V_L$ and $V_D$, and is closer to $V_D$ than $V_L$, from the standpoint of preventing production of a foggy background, that is, the deposition of the toner to the dark potential region.

In any case, the formation of the oscillating electric field having an alternatingly changing electric field, is formed in the developing zone. The waveform of the oscillating bias voltage may be a rectangular wave, a sine wave or the like.

A blade 25 is provided to regulate a thickness of a developer layer formed on the sleeve 21, and is faced to the sleeve 21 with a small clearance therebetween at an outlet of the container 20. It is effective to regulate the thickness of the layer of the developer supplied by the sleeve into the developing zone.

In the non-magnetic sleeve 21, a stationary magnet roller 23 is disposed. In this embodiment, the magnet 23 has three N-poles N1, N2 and N3 and two S-poles S1 and S2. Among these magnetic poles, the N3 and N2 poles have the same polarity so that a repelling magnetic field is formed therebetween, which is effective to remove from the sleeve 21 any developer which has been passed through the developing zone.

The developer once removed from the sleeve 21 is stirred and mixed with the developer within the container 20 by a the screw 24. The mixed developer is attracted onto the sleeve 21 by a magnetic force provided by the magnetic pole N2, and is conveyed into the developing zone by way of the S2 pole.

Figure 6:
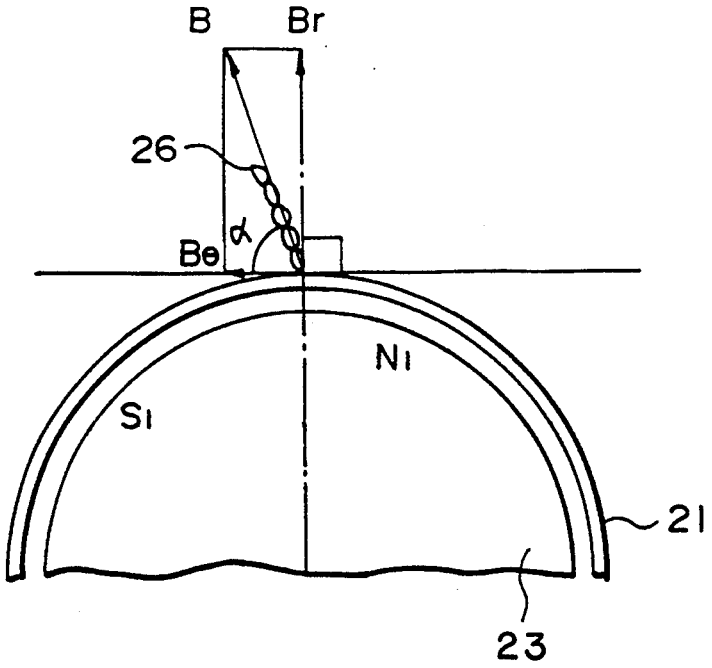
FIG. 6 is a sectional view illustrating an angle of magnetic lines of force.

The N1 and S1 poles are of the opposite polarity and are disposed adjacent to each other. More particularly, the pole N1 is located upstream of a line 1, and the pole S1 is located downstream thereof, where the line 1 is a line connecting the center of the drum 3 and the center of the sleeve 21. On the line 1, the clearance between the drum and the sleeve is a minimum, and it is substantially the center of the developing zone. The pole N1 is located in the former part of the developing zone, and the pole S1 is located downstream of the latter part of the developing zone. In the latter part of the developing zone, there is a region in which an angle a of a magnetic line of force relative to the surface of the sleeve 21 on the sleeve surface is not more than 15 degrees. A position of a magnetic pole is defined as a position where the magnetic flux density (Bγ Gauss) provided by the magnetic pole on the sleeve surface in the direction perpendicular to the surface of the sleeve is a maximum. The angle of the magnetic line of force on the sleeve surface is defined in the following manner. As shown in FIG. 6, the magnetic flux density in a direction perpendicular to the sleeve surface is Bγ Gauss, and the magnetic flux density in a direction tangential to the sleeve surface is Bγ Gauss. Then, the angle α is defined as $\alpha = \tan^{-1}(B\gamma/B\theta)$ The magnetic brush of the developer, and more particularly the chains 26, are directed in this direction, that is, the direction of a vector B. More specifically the chain is inclined at an angle $\alpha$ relative to the sleeve surface.

Figure 7:
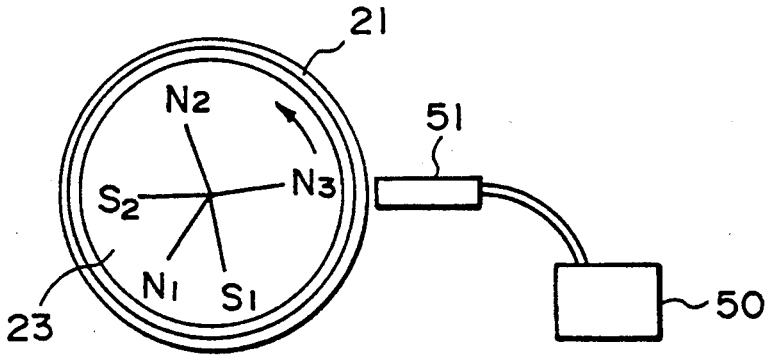
FIG. 7 is a sectional view illustrating a method of measuring magnetic flux density in a perpendicular or radial direction.
Figure 8:
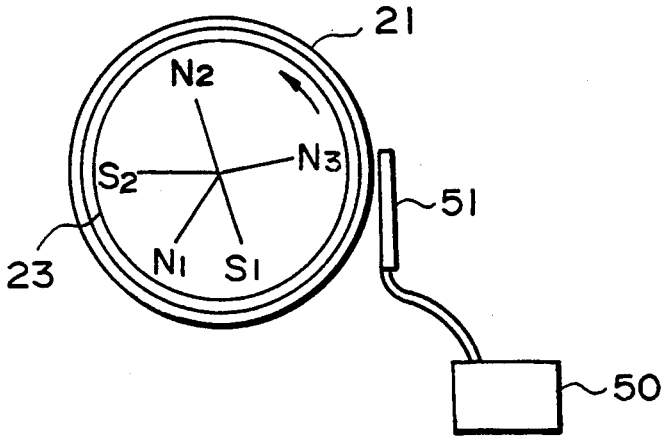
FIG. 8 is a sectional view illustrating a method of measuring a magnetic flux density in a tangential direction.

FIGS. 7 and 8 show an example of a method for measuring the magnetic flux densities $B\gamma$ and $B\theta$. FIG. 7 illustrates a method of measuring the perpendicular or radial magnetic flux density $B\gamma$ at a position on the surface of the developing sleeve 3. For example a Gauss meter, model 640 (available from Bell Laboratories) may be used. In the Figure, the developing sleeve 21 is fixed to take a horizontal position, and the magnet roller 23 in the developing sleeve 21 is rotatable. An axial probe 51 is fixed horizontally with a very small clearance from the developing sleeve 21 with the center of the developing sleeve 21 being at the same level as the probe 51. It is connected with a Gauss meter 50 to detect the magnetic flux density in the radial direction on the surface of the developing sleeve 21. The developing sleeve 21 and the magnet roller 23 are substantially concentric with each other, and therefore, the gap between the developing sleeve 21 and the magnet roller 23 is uniform. Therefore, when the magnet roller 23 is rotated, the radial magnetic flux density $B\gamma$ can be measured on the developing sleeve for any circumferential position. FIG. 8 illustrates a magnetic flux density measuring method for the tangential magnetic flux density on the developing sleeve 3. Similarly to the case of FIG. 7, the developing sleeve 21 is fixed to take the horizontal position, and the magnet roller 23 is rotatably supported in the developing sleeve 21. The axial probe 51 is vertically fixed with a very small gap from the developing sleeve 21 with the center of the developing sleeve 21 being at the same level as the measuring center of the probe 51. In this manner, the tangential magnetic flux density on the developing sleeve is measured. Similarly to the case of FIG. 7, the magnet roller 23 is rotated in the direction indicated by an arrow, and the tangential direction magnetic flux density $B\gamma$ on the sleeve surface is detected for any circumferential position.

Figure 9:
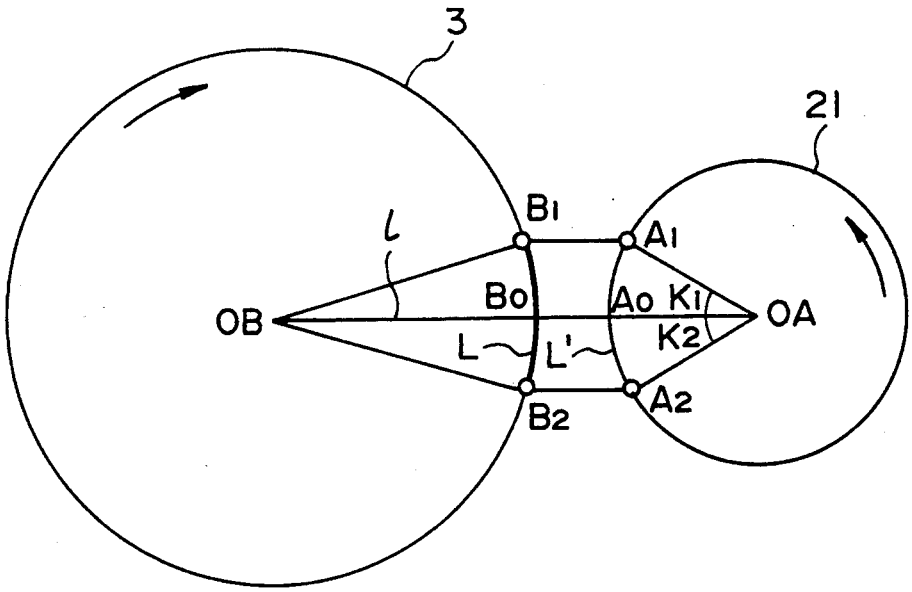
FIG. 9 is a sectional view of a developing zone.

Referring to FIG. 9, description will be made as to the developing zone in detail. Points A0 and B0 are intersections between the developing sleeve 21 and the line 1 passing through the rotational center OA and a rotational center OB of the photosensitive drum 1 and between the photosensitive drum 3 and the line $\mathbf{1}_l$. The line A0–B0 represents the substantial center of the developing zone where the developing sleeve 21 and the photosensitive drum 3 are closest to each other. An upstream end (critical point) B1 and a downstream end (critical point) B2 of such an area of the photosensitive drum 3 as is deposited by the toner, with respect to the peripheral movement direction of the photosensitive drum, define a development width L, that is, a circular arc B1–B2 defines the developing width of the photosensitive drum.

Description will be made as to the method of determining the development width L. An oscillating bias voltage having the same frequency and peak-to-peak level as the bias voltage actually used in the image development, is applied to the sleeve 21. The DC component $V_{DC}$ of the oscillating bias voltage during the measurement is selected so that the difference $V_C$ between it and the surface potential $V_S$ of the photosensitive drum 3 during the measurement is the same as a difference between the image portion potential $V_L$ of the photosensitive member during the actual image developing operation and the DC voltage component $V_{DCA}$ of the oscillating bias voltage, that is, $V_C = V_S - V_{DC} = V_L - V_{DCA}$. Even if the surface potential of the photosensitive member is different, it is empirically confirmed that the amount of the toner deposited to the photosensitive member and the behavior in the developing zone are substantially the same if the development contrast potential $V_C$ is the same.

Then, a bias voltage is applied to the developing sleeve 21 for a period of time Tp corresponding to 4–6 periods of the oscillating bias voltage. A solid black image provided by the above process on the photosensitive drum is transferred onto a transfer material at a transfer position of the image forming apparatus. A width $L_1$ of the solid black image on the transfer material is measured. Here, it is empirically known that the width of the image on the drum is the same as the width of the transferred image.

The development width is calculated in the following manner. The photosensitive drum moves through the developing zone in the oscillating bias voltage application period Tp, and therefore, the image width $L_1$ is longer than the development width L. Taking this into account, the development width is calculated as follows:

$L = L_1 - (Tp \times Vp)$

L: developing width (mm)

$L_1$: pulse application period (sec)

Vp: peripheral speed of the photosensitive drum (mm/sec)

Such measurements are carried out 5–6 times, and the measured development widths L are averaged so that an average development width is determined.

A width L' of the developing zone on the developing sleeve 3, which is a circular arc between critical points A1 and A2 on the developing sleeve, is determined in the following manner. The width is assumed as the width L, and it is also assumed that the central position of the development width L is B0, and that the central position of the developing width L' is A0. On the basis of these assumptions, the critical points B1 and B2 of the development width L and the critical points A1 and A2 of the developing zone width L', are determined by calculation. Here, the developing zone is the zone defined by the critical points A1, A2, B1 and B2. As long as the developing sleeve is concerned, it is between the points A1 and A2. Using the developing zone A1–A2 thus defined, the results in Tables which will be given hereinafter, are obtained.

The former part of the developing zone is the developing zone upstream of A0–B0, where the sleeve and drum are closest to each other, with respect to the advancement of the developing action, and the latter part of the developing zone is the developing zone downstream thereof. The development advancing direction is the movement direction of the surface of the image bearing member (photosensitive drum). Therefore, in the foregoing example in which the drum and the sleeve are moved in the same peripheral direction, the development advancing direction is the same as the movement direction of the surface of the sleeve, whereas in the case where the drum surface and sleeve surface are moved in opposite directions, the development advancing direction is opposite to the movement direction of the sleeve surface. Thus, the words upstream and downstream are defined with respect to the advancing direction of the developing action.

Here, angles between the line 1 and a line connecting the critical point A1 and the sleeve center OA and between the line 1 and a line connecting the critical point A2 and the sleeve center OA, are K1 and K2, as shown in FIG. 9. An angle 81 in FIG. 1 is smaller than the angle K1 of FIG. 9 and is larger than zero. An angle $\theta 2$ in FIG. 1 is larger than the angle K2. The angle $\theta 2$ is larger than the angle $\theta 1$. The angle $\theta 1$ is an angle between the line 1 and a line passing through the magnetic pole N1 position and the sleeve center OA, and the angle $\theta 2$ is an angle formed between the line 1 and a line passing through the magnetic pole S1 position and the sleeve center OA. According to the definition of the developing zone, the angles K1 and K2 are equal, and thins is close to what is actually observed.

In any case, the N1 pole of FIG. 1 is located in the former part of the developing zone. In the former part of the developing zone, the photosensitive drum 3 surface is contacted by a magnetic brush which is sparsely formed by the radial magnetic force component on the sleeve surface by the magnetic pole N1. Therefore, the developing action is carried out at high efficiency in the former half in the developing zone.

On the other hand, the magnetic pole S1 is located further downstream of the latter part of the developing zone. In the latter part, there is a region in which the angle formed between the magnetic line of force relative to the sleeve surface is not more than 15 degrees. When the angle is not more than 15 degrees, the magnetic brush, in other words, the chains of the developer, lie on the sleeve surface at high density. Therefore, in the latter part of the developing zone, the pixels not developed in the former part of the developing zone are developed.

Figure 10A:
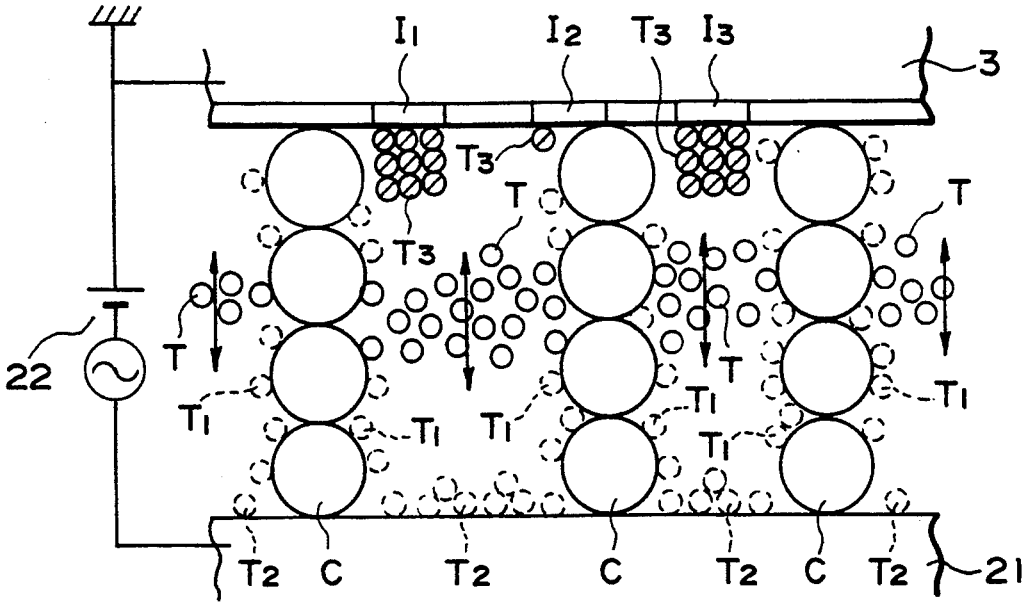
FIGS. 10A and 10B are sectional views illustrating behavior of the developer particles in an apparatus according to an embodiment of the present invention.
Figure 10B:
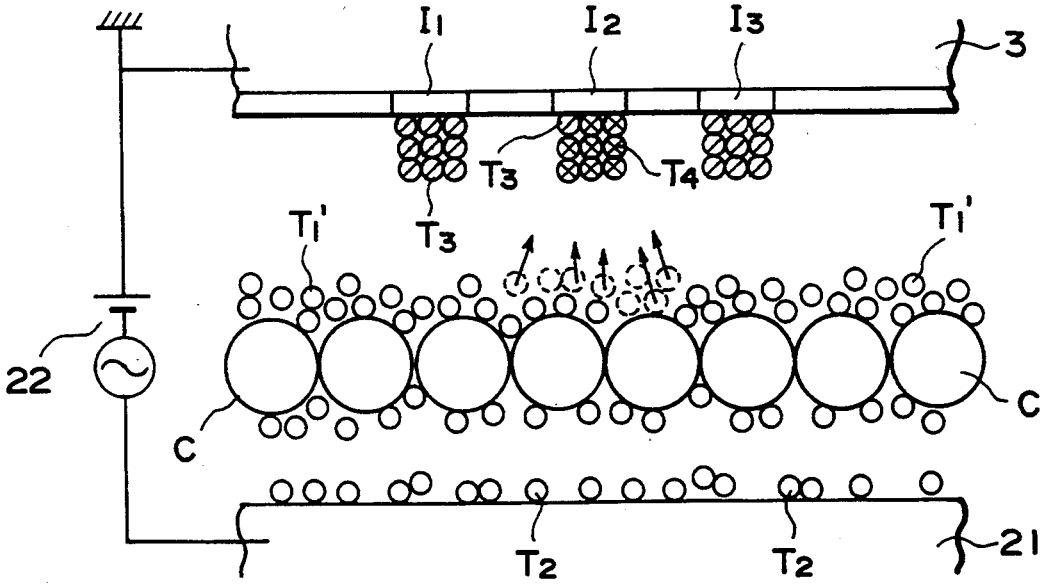

Referring to FIGS. 10A and 10B, this will be described in detail. FIGS. 10A and 10B show the behavior of the developer in the developing zone. FIG. 10A shows the former part of the developing zone, and FIG. 10B shows the latter part. In these FIGS. $I_1$, $I_2$ and $I_3$ are fine dot latent images constituting a low density image region.

In FIG. 10A, the magnetic brush (chains) of the magnetic carrier particles C is erected on the sleeve 21 surface to such an extent to contact the drum 3.

When the above-described oscillating electric field is formed, the toner particles T1 deposited on the chains of the carrier particles, are released from the chains, and oscillate. The toner particles $t_2$ deposited on the surface of the sleeve 21, are released from the sleeve surface, and oscillate. The oscillating motion of the toner is schematically shown by T.

The latent images $I_1$, $I_2$ and $I_3$ are developed by the oscillating toner T.

Since the density of the magnetic brush is not high, not only the toner T1 released from the magnetic brush toward the drum, but also the toner T2 released from the sleeve surface toward the drum, are used for the development. T3 represents toner particles deposited on the latent images $I_1$, $I_2$ and $I_3$.

Therefore, in the former part of the developing zone, the development efficiency is high so that a sufficient amount of the toner is deposited at the high density portion, and in addition, a sufficient amount of toner can be deposited to each of the fine dot latent images constituting the low density image portion.

However, as described hereinbefore, in the former part of the developing zone, the sparse magnetic brush is contacted to the drum, and therefore, an insufficient amount of the toner is deposited to a part of ($I_2$ in the Figure) of the dot images, or the toner is scraped off with the result of no toner deposition. Since the dot latent image constituting the low density area is very small, the no-toner portion is significant so that the reproducibility of the low density portion is decreased.

In addition, the size of the dot latent image is relatively small in the middle tone region which is between the low density region and the high density region, and therefore, the no-toner portion is remarkable with the result of a roughened image.

In consideration of the above, the step shown in FIG. 10B is provided to supply the toner to the dots.

In the latter part of the developing zone in FIG. 10, the magnetic brush (chains) of the carrier particles C extends substantially along the surface of the sleeve 21, and therefore, the developer is distributed at high density. For this reason, even if an oscillating electric field is formed, the toner T2 retained on the surface of the sleeve 21 does not reach the drum, or the amount, if any, is small as compared with the case of FIG. 10. Therefore, the development efficiency is low in the part shown in FIG. 10A. However, the developing power difference between the magnetic brush existing portion (FIG. 10A) and the non-existing portion as seen in FIG. 10A part, decreases in the part of FIG. 10B.

The toner T1′ deposited at such a side of the chains of the toner extending along the surface of the sleeve 21 that is faced to the drum, is reciprocated under the influence of the oscillating electric field. It should be noted that the vibrating operation occurs at a position closer to the drum than the surface of the sleeve. Therefore, not only the toner right faced to the fine dot latent image $I_2$ but also the toner T1′ therearound, gathers toward the fine latent image dot $I_2$, as indicated by an arrow, during the vibrating or reciprocating portion. In this manner, a sufficient amount of toner can be supplied to the small image dot.

Therefore, the reproducibility of the low density image region constituted by extremely small dots, can be improved. In addition, the roughness of the intermediate tone level image region constituted by slightly larger dots, can be avoided.

In addition, the excess much toner deposited to the latent image in the former half of the developing zone and the foggy background toner deposited in the background area, are removed by the oscillating electric field in the latter half of the developing zone all fall down on the surface of the sleeve in the latter half of the developing zone as shown in FIG. 10B. The magnetic brush is slightly contacted to or is out of contact from, the photosensitive drum, and therefore, the magnetic brush does not scrape the toner off the dot latent image. Even if it scrapes the toner, the amount is very small.

Where the chains of the developer are kept from contact with the photosensitive drum in the latter part of the developing zone in FIG. 10B, the image is not at all disturbed by the chains of the developer. Therefore, the image reproduction in the high light portion is very much improved, and the roughness of the image can be avoided. Where the chains of the developer are lightly contacted to the drum in the latter half of the developing zone, a high quality image can be provided in similar manner, but thin lines are reproduced as thinner lines, and the dots in the high light portion are thinned slightly, with a slightly lower degree foggy background and toner scattering. This is because the toner particles in the marginal portion of the dot image are scraped off by a savenging effect of the chains.

As will be made clear later, if the region in which the magnetic line of tie force is inclined at 15 degrees or less relative to the sleeve surface in the latter part of the developing zone, a high quality toner image can be provided with a small dot latent image being developed in good order. It is particularly preferable that the latter part of the developing zone includes a region in which the angle of the magnetic line of force is zero relative to the sleeve surface.

Figure 11:
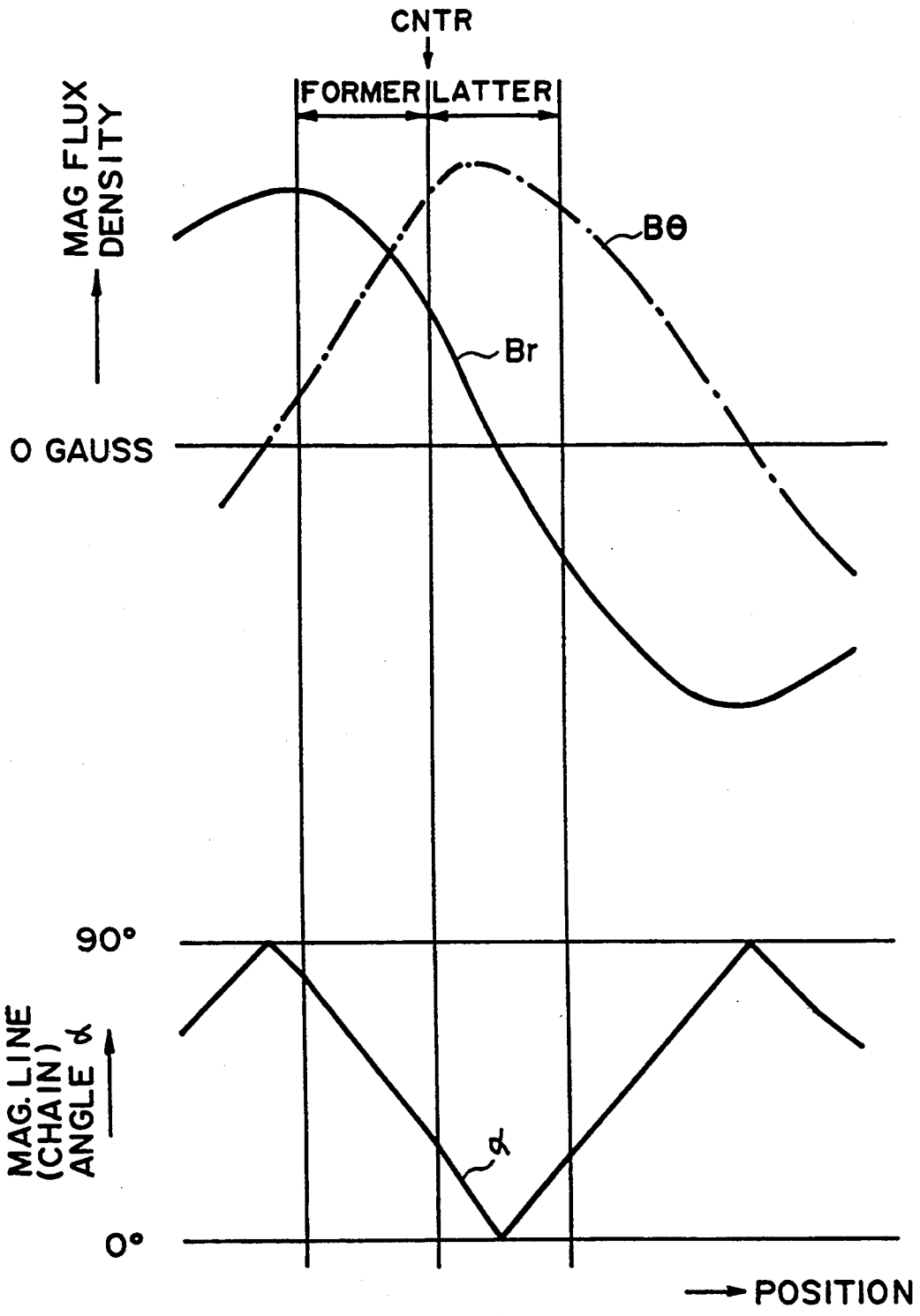
FIG. 11 is a graph of a magnetic flux density vs. magnetic force line angle.

Referring to FIG. 11, there is shown such an example. The top part of FIG. 11 shows distributions of the magnetic flux densities $B\gamma$ and $B\theta$ in the radial and tangential directions on the sleeve surface. The bottom part of FIG. 11 shows the angle $\alpha$ of the magnetic line of force corresponding to $B\gamma$ and $B\theta$.

In the example of FIG. 11, the latter part of the developing zone includes a part in which the angle $\alpha$ is zero. Where the angle $\alpha$ is zero degree, the chains of the developer extend substantially parallel with the surface of the sleeve with highest density. Therefore, the reproducibility of the small dot image is improved, so that the image qualities are increased with high resolution in the low density region and intermediate tone level region.

Examples and Comparison Examples will be described, wherein the dark portion potential (background potential) of the photosensitive drum was −700 V and the light portion potential (visualized portion potential) was −200 V. The oscillating voltage applied to the sleeve had a frequency of 2 KHz and a peak-to-peak voltage Vpp of 2 KV, which was biased by a DC voltage of −550 V. The outer diameter of the photosensitive drum was 80 mm; the peripheral speed thereof was 160 mm/sec; an outer diameter of the developing sleeve was 32 mm; and the peripheral speed thereof was 280 mm/sec. The smallest gap between the photosensitive drum and the sleeve was 0.5 mm. The gap between the sleeve and the developer layer thickness regulating blade was 0.8 mm in Examples 1, 3, 5, 7, 9 and 11 and in Comparison Examples 1–7, and was 0.7 mm in Examples 2 and 6, and was 0.6 mm in Examples 4, 10 and 12.

The toner was a negatively chargeable toner containing coloring agent and had a volume average particle size of 8 microns. The carrier particles were ferrite particles each coated with a very thin resin material and had a weight average particle size of 45 microns.

Table 1 shows magnets A–F used in the sleeve.

TABLE 1

| Magnet | First pole (N1) flux $B\gamma$ (Gauss) | First pole (N1) flux $B\theta$ (Gauss) | Second pole (S1) flux $B\gamma$ (Gauss) | Second pole (S1) flux $B\theta$ (Gauss) | Pole-pole distance $\theta 1 + \theta 2$ (deg.) |
|---|---|---|---|---|---|
| A | 760 | 150 | 800 | 60 | 34 |
| B | 740 | 120 | 760 | 80 | 30 |
| C | 780 | 90 | 780 | 110 | 40 |
| D | 810 | 80 | 800 | 100 | 50 |
| E | 1000 | 160 | 650 | 50 | 78 |
| F | 780 | 80 | 760 | 100 | 52 |

Table 2 shows angles $\theta 1$, $\theta 2$, K1, K2 and $\alpha$ (degrees) in Examples and Comparison Examples. In this Table "CON" means that the magnetic brush of the developer was contacted to the photosensitive member, and "NON" means that it is not contacted.

TABLE 2

| | Magnet | Pole positions $\theta_1$ | Pole positions $\theta_2$ | Former part $K_1$ | Former part $\alpha$ | | Latter part $K_2$ | Latter part $\alpha$ | |
|---|---|---|---|---|---|---|---|---|---|
| Ex. | | | | | | | | | |
| 1 | A | 10 | 24 | 14 | 28–90 | CON | 14 | 0–43 | CON |
| 2 | A | 10 | 24 | 14 | 28–90 | CON | 14 | 0–43 | NON |
| 3 | A | 6 | 28 | 14 | 50–90 | CON | 14 | 0–50 | CON |
| 4 | A | 6 | 28 | 13 | 50–90 | CON | 14 | 0–50 | NON |
| 5 | B | 10 | 20 | 15 | 21–90 | CON | 15 | 0–79 | CON |
| 6 | B | 10 | 20 | 15 | 21–90 | CON | 15 | 0–79 | NON |
| 7 | C | 10 | 30 | 13 | 51–90 | CON | 13 | 0–51 | CON |
| 8 | C | 10 | 30 | 13 | 51–90 | CON | 13 | 0–51 | NON |
| 9 | C | 6 | 34 | 12 | 66–90 | CON | 12 | 7–69 | CON |
| 10 | C | 6 | 34 | 11 | 69–90 | CON | 11 | 15–73 | NON |
| 11 | D | 10 | 40 | 11 | 55–90 | CON | 11 | 10–55 | CON |
| 12 | D | 10 | 40 | 10 | 55–90 | CON | 10 | 15–55 | NON |
| Comp. Ex. | | | | | | | | | |
| 1 | A | 0 | 34 | 10 | 59–90 | CON | 10 | 28–79 | CON |
| 2 | A | 17 | 17 | 16 | 0–74 | NON | 16 | 0–90 | NON |
| 3 | A | 24 | 10 | 14 | 0–43 | NON | 14 | 43–90 | CON |
| 4 | E | 0 | 78 | 10 | 66–90 | CON | 10 | 51–81 | CON |
| 5 | E | 5 | 73 | 9 | 66–90 | CON | 9 | 39–66 | CON |
| 6 | E | 8 | 70 | 9 | 57–84 | CON | 9 | 31–57 | CON |
| 7 | F | 10 | 42 | 10 | 58–90 | CON | 10 | 18–58 | CON |

Table 3 shows evaluations of image qualities of the developed images in Examples 1–12 and Comparison Examples 1–7. In Table 3 "E" means excellent; "G" means good; "F" means slightly bad; and "N" means no good. "Dmax" is a reflection image density at the highest density portion.

TABLE 3

| | Evaluations: High light | Halftone | Dmax | Total | Remarks |
|---|---|---|---|---|---|
| Ex. | | | | | |
| 1 | E | E | 1.68 | E | |
| 2 | E | E | 1.66 | E | |
| 3 | E | E | 1.69 | E | |
| 4 | E | E | 1.64 | E | |
| 5 | E | E | 1.68 | E | |
| 6 | E | E | 1.66 | E | |
| 7 | E | E | 1.68 | E | |
| 8 | E | E | 1.66 | E | |
| 9 | G | G | 1.68 | G | |
| 10 | G | G | 1.64 | G | |
| 11 | G | G | 1.68 | G | |
| 12 | G | G | 1.66 | G | |
| Comp. Ex. | | | | | |
| 1 | N | N | 1.69 | N | unevenness |
| 2 | E | E | 1.29 | F | in solid |

TABLE 3-continued

| | Evaluations | | | | |
|---|---|---|---|---|---|
| | High light | Halftone | Dmax | Total | Remarks |
| | | | | | black |
| 3 | N | N | 1.46 | N | |
| 4 | N | N | 1.70 | N | |
| 5 | F | F | 1.70 | F | |
| 6 | F | F | 1.68 | F | |
| 7 | F | F | 1.68 | F | |

In Examples 1–8, the reproducibility of the high light portion (low density portion) is very good, and the halftone portion (intermediate tone level portion) does not have roughness. In addition, the high image density can be reproduced with high resolution.

In Examples 9–12, the reproducibility of the high light portion is good, and a problematic roughness does not appear in the halftone portion. The image density is high, and a practical developed image is provided.

As will be understood from the foregoing Examples 1–12, the good dot distribution developed image can be provided by a developing device, in which the first magnetic pole is positioned upstream of the closest position between the image bearing member and the developer carrying member and in the former part of the developing zone; the second magnetic pole having the opposite polarity is disposed downstream of the developing zone; the latter part of the developing zone includes a region in which the angle formed between the surface of the developer carrying member and the magnetic line of force is not more than 15 degrees; and the chains of the developer are contacted to the image bearing member at least in the former part of the developing zone. Also, as will be understood from the foregoing Examples 1–12, good quality dot distribution developed images can be provided by the developing apparatus, in which the first and second magnetic poles having opposite polarities are disposed on opposite sides of the position where the image bearing member and the developer carrying member are closest to each other; the first magnetic pole is disposed upstream of the closest position; the distance between the first magnetic pole position and the closest position is shorter than the distance between the second magnetic pole position and the closest position; the magnetic brush of the developer is erected to be contacted to the image bearing member in the former part of the developing toner so that the tone deposited on the developer carrying member surface as well as the toner deposited on the magnetic brush of the developer can be used for the development; and in the latter part of the developing zone, there is a region where the angle of the magnetic line of force is not more than 15 degrees.

As will be understood from the Examples 1–8, it is preferable that the, latter part of the developing zone contains a region in which the angle of the magnetic line of force relative to the surface of the developer carrying member is zero.

It will also be understood that the angle between the first magnetic pole position and the second magnetic pole position is not more than 50 degrees. The reason is considered as being that the degree of change from the erected state of the chain to the lying chain, is greater.

In Comparison Examples 1 and 4, the first magnetic pole is disposed at the position where the sleeve and the drum is closest, that is, the center of the developing zone, as in the most conventional magnetic pole location. It will be understood that the reproducibility of the high light portion is poor, and the halftone portion image is roughened.

In Comparison Example 2, there is a region where the angle of the magnetic line of force (the angle of the chain of the developer) is zero, in the latter part of the developing zone. However, both of the first and second magnetic poles are disposed outside the developing zone, and the developer layer is out of contact with the photosensitive member in the former or latter part of the developing zone. In such a case, the reproducibility is very good in the high light image portion. In addition, the image of the halftone portion is hardly roughened. However, the development efficiency is lower with low image density reproduced, and the solid black portion is washed out.

In Comparison Example 3, the magnetic brush of the developer is out of contact with the photosensitive member in the former part of the developing zone, but is contacted in the latter part. In this case, the halftone image is roughened, and the reproducibility of the high light portion is poor with slightly low image density.

In Comparison Examples 5, 6 and 7, the first magnetic pole is disposed in the former part of the developing zone, and the second magnetic pole is downstream of the latter part of the developing zone ($\theta 1 < \theta 2$). In the former part of the developing zone, the magnetic brush of the developer is contacted to the photosensitive member. In the latter part of the developing zone, the magnetic brush is inclined toward the sleeve surface as compared with the former part of the developing zone, however, there is no region where the angle $\alpha$ is not more than 15 degrees in the latter part of the developing zone. In this case, the reproducibility of the high light portion is slightly poor, and the halftone image reproduced involves non-negligible roughness with poorer resolution.

The investigations have been made as to the phenomenon of the carrier particles remaining on the photosensitive member and taken out of the developing zone, more particularly, the relation between the occurrence of the carrier deposition and the saturation magnetization of the carrier particles (emu/g). The results of the investigations are shown in Table 4. In this Table, "E" means substantially no carrier deposition; "G" means that the carrier deposition is negligibly small; "F" means slightly remarkable carrier deposition; and "N"means that the carrier deposition is significantly remarkable.

TABLE 4

| Dev. Condition | Saturation Magnification | Carrier Deposition |
|---|---|---|
| Same as Ex. 1 | 60 | E |
| | 43 | G |
| | 34 | F |
| | 20 | N |
| Same as Ex. 7 | 60 | E |
| | 43 | G |
| | 34 | F |
| | 20 | N |

As will be understood from Table 4, the carrier deposition may be suppressed to a satisfactory extent if the saturated magnetization of the carrier particle is not less than 40 emu/g.

As for the insulating non-magnetic toner, it preferably has a volume average particle size of not less than 4 microns and not more than 10 microns from the standpoint of providing a high resolution developed image.

The volume average particle size of the toner is measured in the following manner:

A Coalter Counter TA-II (Coalter Corporation) is used, using a 100 microns aperture. To the counter, an interface (Nikkaki Kabushiki Kaisha, Japan) outputting a number average distribution and a volume average distribution, and CX-i personal computer (Canon Kabushiki Kaisha, Japan) are connected. Using electrolyte (first class natrium chloride), 1% NaCl water solution is prepared.

To the electrolyte solution (100–150 ml), 0.1–5 ml of surface active agent (dispersing agent) (preferably alkylbenzene sulfonate) is added. Further, 0.5–50 mg of the material to be tested is added thereto.

The electrolyte suspending the material is subjected to the ultrasonic dispersing treatment for approximately 1–3 min. Using an aperture of 100 microns, a particle size distribution in the range of 2–40 microns is measured using the counter TA-II to obtain the volume distribution.

From the volume distribution obtained the volume average particle size of the material is obtained.

From the standpoint of better mixture with such a toner and satisfactory triboelectric charging of such toner, the magnetic carrier particles preferably have a weight average particle size of 30–80 microns, most preferably 40–70 microns. The resistance of the carrier particles is preferably $10^7$–$10^{12}$ ohm.cm. The carrier particles may be a magnetic material such as ferrite, coated with a thin resin material.

The weight average particle size of the carrier can be determined in the following manner. First, the particle size distribution is determined in the following manner:

1. Carrier particles of approximately 100 g are taken, and are weighted in the order of 0.1 g.
2. Sieves of 100–400 mesh are used.

More particularly, 400 mesh, 145 mesh, 200 mesh, 250 mesh, 350 mesh and 400 mesh sieves are stacked in order from the top with a receiving plate at the bottom, and the material is on the top sieves, which is then covered.

3. They are placed on a vibrator which revolves horizontally at 285+6 per minute with 150±10 vibration per minute, for 15 minutes.
4. Then, the materials on the filters and plates are weighed in the order of 0.1 g.
5. The volume percentages are calculated in the order of 0.01, and are rounded to one decimal places.

In the above method, the dimension of the sieve is 200 mm in the inside diameter above the sieve surface, and the distance between adjacent sieve is 45 mm. The sum of the weights of the carrier particles on the filters and the plates must be not less than 99% of the original material.

The average particle size is determined using the above determined particle size distribution and the following equation:

Average particle size ($\mu$)=1/100{(remainder on 100 mesh sieve)×140+(remainder on 145 mesh sieve)×122+(remainder on 200 mesh sieve)×90+(remainder on 250 mesh sieve)×68+(remainder on 350 mesh sieve)×52+(remainder of 400 mesh sieve)×38+(passed all sieves)×17}.

Less than 150 mesh carrier particles is calculated by placing 50 g of the material on 150 mesh standard sieve, and being sucked from the bottom. It is calculated from the reduction of the weight.

As for the measurement of the resistance of the magnetic carrier particles, use is made of a sandwich type cell having a measuring electrode area of 4 $cm^2$ and an electrode gap of 0.4 cm. A load of 1 kg is applied to one of the electrodes with a voltage E (V/cm) applied between the electrodes. The resistance of the magnetic particles is determined from the electric current flowing through the circuit.

In order that both the toner deposited on the magnetic brush erected on the sleeve and the toner deposited on the sleeve surface, are transferred to the photosensitive member, that is, are used for the development in the former part of the developing zone, it is preferable that the volumetric ratio of the carrier particles in the developing zone, that is, the ratio of the volume occupied by the carrier particles in the volume of the developing zone (A1, A2, B2 and B1 in FIG. 9), is preferably 5–30%.

Here, the volumetric ratio is defined as $(M/h)\times(1/\rho)\times[C/(T+C)]$.

Where M is weight of the developer per unit area of the sleeve (non-erected state) ($g/cm^2$); h is the height of the developing zone; $\rho$ is the true density of the magnetic carrier particles ($g/cm^3$); and C/(T+C) is the weight ratio of the carrier particles in the developer on the sleeve.

When the volumetric ratio is smaller than 5%, the image density is so low that stripe non-uniformity easily results in a high density image portion. If, on the other hand, it is larger than 30%, the developer tends to stagnate in the developing zone with the tendency of non-uniformity.

The above-described volumetric ratio can be provided by properly and interrelatedly selecting the gap between the sleeve and the developer layer regulating blade, the gap between the sleeve and the photosensitive member and the toner content in the developer.

However, the minimum gap between the sleeve and the photosensitive member is preferably 0.3–1.0 mm from the standpoint of using the effect of the vibrating electric field. If it is smaller than 0.3 mm, it is difficult to form such a thin developer layer as to provide the above-described volumetric ratio. If it is larger than 1.0 mm, the image quality is degraded.

The gap between the sleeve and the developer layer thickness regulating blade is preferably not less than 0.2 mm so that the developer does not clog therein. In order to stabilize the layer thickness, it is not more than 1.5 mm. The layer thickness of the developer provided by the blade is preferably lower than the minimum gap between the sleeve and the photosensitive member when it is measured without the first and second magnetic poles.

The frequency of the oscillating bias voltage is preferably not less than 300 Hz from the standpoint of suppressing the production of foggy background, and from the standpoint of assuring the reproducibility of the high light portion and the intermediate level tone portion, it is preferably not more than 8 KHz.

The peak-to-peak voltage Vpp of the oscillating voltage is preferably not less than 300 V from the standpoint of preventing image roughness in low density, low contrast and high image density portions, and it is preferably not more than 3000 V from the standpoint of assuring the reproducibility of the high light portion and from the standpoint of preventing leakage through the photosensitive member.

The radial direction magnetic flux densities of the first and second magnetic poles on the sleeve surface Bγ is preferably not less than 500 Gausses from the standpoint of carrier deposition prevention to the photosensitive member. From the standpoint of preventing foggy background due to the strong abutment of the magnetic brush to the photosensitive member, it is preferably not more than 2000 Gausses.

The rotational direction of the sleeve may be the opposite of the rotation direction of the photosensitive member in the developing zone.

In the foregoing embodiment, the first and second magnetic poles are N and S, but the first and second magnetic poles may be S and N.

The present invention is applicable to the image forming apparatus using a dithering method rather than a PW method for the purpose of better reproducibility of the high light (low density) and intermediate tone portions.

In addition, the present invention is applicable to an image forming apparatus in which dot latent images are formed on the electrophotographic photosensitive member by selective actuation of an LED array in accordance with the image signals to be recorded, or an image forming apparatus in which ion current is modulated in accordance with the image to be recorded to form dot latent images on the dielectric member.

As described in the foregoing, according to the present invention, the small dot latent images can be developed with good reproducibility. The intermediate tone level portion can be reproduced without image roughness. A high density portion can be developed in good order, and therefore, the dot distribution developed images can be formed with high resolution.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

an image bearing member for bearing a latent image;

a developer carrying member, opposed to said image bearing member, for carrying a developer into a developing zone formed therebetween; and magnetic field generating means, disposed in said developer carrying member, for generating a magnetic field;

wherein a magnetic flux density provided on a surface of said developer carrying member by said magnetic field generating means changes continuously in the developing zone, and becomes 0 Gauss at a position within the developing zone and downstream of a center of the developing zone with respect to a movement direction of said developer carrying member.

2. An apparatus according to claim 1, wherein the developer comprises toner particles and carrier particles.

3. An apparatus according to claim 2, wherein a saturated magnetization of the carrier particles is not less than 40 cm/g.

4. An apparatus according to claim 2, wherein the toner particles are non-magnetic toner particles and have a volume average particle size of 4–10 microns.

5. An apparatus according to claim 2, wherein the carrier particles have a weight average particle size of 30–80 microns and a resistance of $10^7$–$10^{12}$ ohm-cm 6. An apparatus according to claim 1, wherein the latent image is a dot image.

7. An apparatus according to claim 6, wherein said developing apparatus reverse-develops the latent image.

8. An apparatus according to claim 1, wherein said magnetic field generating means has a first magnetic pole at a first position upstream of a central position where said image bearing member and said developer carrying member are closest to each other, and a second magnetic pole at a second position downstream of said central position, said second magnetic pole having a magnetic polarity which is opposite that of said first magnetic pole, and wherein a distance between the second position and the central position is larger than a distance between the first position and the central position.

9. An apparatus according to claim 8, wherein the first position is located upstream of the center of the developing zone and in the developing zone.

10. An apparatus according to claim 8, wherein a magnetic flux density on the surface of said developer carrying member in a direction perpendicular to the surface provided by said first and second magnetic poles is 500–2000 Gauss.

11. An apparatus according to claim 1, wherein a gap formed between said image bearing member and said developer carrying member at the central position is 0.3–1.0 microns.

12. An apparatus according to claim 1, further comprising means for applying an oscillating voltage to said developer carrying member to form an oscillating electric field between said image bearing member and said developer carrying member.

13. An apparatus according to claim 12, wherein the oscillating voltage has a peak-to-peak voltage of 300–3000 V.

* * * * *

UNITED STATES PATENT AND TRADEMARK OFFICE

CERTIFICATE OF CORRECTION

PATENT NO. : 5,402,215

DATED : March 28, 1995

INVENTOR(S) : MASAAKI YAMAJI

It is certified that error appears in the above-indentified patent and that said Letters Patent is hereby corrected as shown below:

Title page,

At [57] ABSTRACT

Line 12, "poles" should read --poles having-- and "polarities" should read --polarities, the--.

Line 18, "include" should read --includes--.

Column 1

Line 64, "Therefore" should read --Therefore,--.

Column 4

Line 4, "is" should read --are--.
Line 65, "1 V) should read -- -1 V)--.

Column 5

Line 12, "Widths" should read --widths--.
Line 67, the force in a" should read --a force in the--.

UNITED STATES PATENT AND TRADEMARK OFFICE

CERTIFICATE OF CORRECTION

PATENT NO. : 5,402,215

DATED : March 28, 1995

INVENTOR(S) : MASAAKI YAMAJI

It is certified that error appears in the above-indentified patent and that said Letters Patent is hereby corrected as shown below:

Column 6

Line 8, "to," should read --to--.
Line 41, "the" should be deleted.
Line 56, "angle a" should read --angle α--.

Column 7

Line 5, "specifically" should read --specifically,--.
Line 12, "example" should read --example,--.

Column 9

Line 8, "angle 81" should read --angle θ1--.
Line 18, "thins" should read --this--.

Column 10

Line 47, "much" should be deleted.

UNITED STATES PATENT AND TRADEMARK OFFICE

CERTIFICATE OF CORRECTION

PATENT NO. : 5,402,215

DATED : March 28, 1995

INVENTOR(S) : MASAAKI YAMAJI

It is certified that error appears in the above-indentified patent and that said Letters Patent is hereby corrected as shown below:

Column 13

Line 48, "tone" should read --toner--.
Line 55, "the," should read --the--.

Column 15

Line 21, "obtained" should read --obtained,--.
Line 48, "places." should read --place.--

Signed and Sealed this

Eleventh Day of July, 1995

Bruce Lehman

*Attest:*

BRUCE LEHMAN

*Attesting Officer*

*Commissioner of Patents and Trademarks*